US007178360B2

(12) United States Patent
Ogata et al.

(10) Patent No.: US 7,178,360 B2
(45) Date of Patent: Feb. 20, 2007

(54) EJECTOR

(75) Inventors: Gota Ogata, Oobu (JP); Hirotsugu Takeuchi, Nagoya (JP); Yasuhiro Yamamoto, Anjo (JP)

(73) Assignee: Denso Corporation, Kariya (JP)

( * ) Notice: Subject to any disclaimer, the term of this patent is extended or adjusted under 35 U.S.C. 154(b) by 162 days.

(21) Appl. No.: 11/082,930

(22) Filed: Mar. 17, 2005

(65) Prior Publication Data

US 2005/0204771 A1 Sep. 22, 2005

(30) Foreign Application Priority Data

Mar. 22, 2004 (JP) ..... 2004-082904

(51) Int. Cl.
*F25B 1/06* (2006.01)

(52) U.S. Cl. ..... 62/500

(58) Field of Classification Search ..... 62/116, 62/170, 500, 527, 528; 417/187, 198
See application file for complete search history.

(56) References Cited

U.S. PATENT DOCUMENTS 6,729,158 B2 * 5/2004 Sakai et al. ..... 62/500
6,779,360 B2 * 8/2004 Kawamura et al. ..... 62/500
6,858,340 B2 * 2/2005 Sugawara et al. ..... 429/34
6,904,769 B2 * 6/2005 Ogata et al. ..... 62/500
6,941,768 B2 * 9/2005 Ikegami et al. ..... 62/500
7,040,117 B2 * 5/2006 Nishida et al. ..... 62/500
7,062,929 B2 * 6/2006 Nishida et al. ..... 62/170

FOREIGN PATENT DOCUMENTS

JP 2003-090635 3/2003
JP 2003-302113 A * 10/2003

* cited by examiner

*Primary Examiner*—Mohammad M. Ali
(74) *Attorney, Agent, or Firm*—Harness, Dickey & Pierce, PLC

(57) ABSTRACT

The invention relates to a variable capacity type ejector capable of more precisely adjusting a flow rate of refrigerant in a range in which a displacement means can displace a needle and also capable of increasing a flow rate of refrigerant when the needle valve is fully opened. In the needle valve 24 which changes the degree of opening (throat portion area) of the nozzle 18 when the needle is displaced in the axial direction R of the throttle portion 18*b*, the second tapered portion 24*b* is formed on the throat portion 18*a* side of the first tapered portion 24*a*, and the taper angle θ2 of the second tapered portion 24*b* is formed larger than the taper angle θ1 of the first tapered portion 24*a*.

3 Claims, 6 Drawing Sheets

EJECTOR

BACKGROUND OF THE INVENTION

1. Field of the Invention

The present invention relates to an ejector, which is a decompressing means for decompressing fluid, and to a momentum transfer type pump for transferring fluid by an entraining action of entraining hydraulic fluid jetting out at high speed. The present invention is effectively applied to a hot water supply device, a refrigerating machine, an air conditioner for vehicle use, and so forth, in which an ejector is adopted as a decompressing means for decompressing refrigerant and as a pump means for circulating the refrigerant.

2. Description of the Related Art

In the conventional ejector which is a refrigerant decompressing means and a refrigerant circulating means, the flow rate of the refrigerant passing through the ejector is adjusted. For example, this type ejector is disclosed in the official gazette of JP-A-2003-90635.

In this conventional example, in the same manner as that of the first embodiment of the present invention, a variable flow rate type ejector is applied to a cycle (ejector cycle shown in FIG. 1) of a hot water supply device. Therefore, the constitution of the ejector (shown in FIG. 2) is substantially the same as that of the embodiment of the present invention. However, the shape of the tapered portion 50, which is formed at an end portion of the needle 24 on the nozzle 18 side, is different from that of the embodiment of the present invention.

As shown in FIG. 8, the tapered portion 50 of the conventional example is formed with one taper angle θ3. When the needle 24 is displaced in the axial direction R (the upward and downward direction in FIG. 8) of the nozzle by the displacement means, the throat portion 18*a* can be changed, that is, the degree of opening of the nozzle 18 can be changed, that is, the passage area, in which refrigerant can pass through, can be changed. In other words, it is possible to increase and decrease a flow rate of the refrigerant passing through the nozzle 18.

In the conventional example, when the needle valve 24 is displaced in the refrigerant jetting direction (the downward direction in FIG. 8) R1, the degree of opening of the nozzle 18 is decreased. When the needle valve 24 is displaced in the direction opposite to the refrigerant jetting direction (the upward direction in FIG. 8) R2, the degree of opening of the nozzle 18 is increased.

Due to the foregoing, when the compressor is rotated at high speed, that is, when a quantity of the refrigerant flowing into the ejector is large, it is possible to increase the degree of opening of the nozzle 18 so that a quantity of the refrigerant passing through the nozzle (ejector) can be increased. Accordingly, in the evaporator in the ejector cycle, the refrigerant absorbs a larger quantity of heat, and in the water refrigerant heat exchanger (radiator), a larger quantity of heat can be radiated to hot water to be supplied. That is, it is possible to enhance the heating capacity of heating hot water in the case where a quantity of the refrigerant flowing in the cycle is large.

However, in the ejector of the above prior art, when a change in the throat area with respect to the change in the displacement of the needle 24 is reduced in order to stabilize the operation of the cycle by more precisely adjusting a flow rate of the refrigerant, the taper angle θ3 of the tapered portion 50 is necessarily reduced. In this case, the length of the tapered portion 50 is naturally prolonged.

However, the range, in which the displacement means can displace the needle in the axial direction R, is limited. Therefore, in the case where the taper angle θ3 of the tapered portion 50 is small, it is impossible to fully open the throat area. For the above reasons, especially when a flow rate of the refrigerant is high, the high-pressure-side pressure tends to rise, and it becomes necessary to conduct control so that the number of revolutions per second of the compressor can be reduced.

SUMMARY OF THE INVENTION

The present invention has been accomplished to solve the above problems. It is an object of the present invention to more precisely adjust a flow rate of refrigerant in the range in which the displacement means can displace the needle. It is another object of the present invention to increase a flow rate of refrigerant at the time when the needle is fully opened.

In order to accomplish the above objects, the present invention provides an ejector comprising: a high pressure space (17) into which high pressure fluid flows from an inlet (16); a throttle means (18) having a throttle portion (18*b*) by which a passage area of the high pressure fluid is reduced from the high pressure space (17) toward a throat portion (18*a*); a needle valve (24) for changing a degree of opening of the throttle means (18) when the needle valve (24) is displaced in the axial direction (R) of the throttle portion (18*b*); a tapered portion (24*a*, 24*b*) formed at an end portion on the throat portion (18*a*) side of the needle valve (24); and a suction space (23*a*) having a second inlet (19) into which fluid flows, the throttle means (18) being arranged in the suction space (23*a*), the fluid being sucked from the second inlet (19) into the suction space (23*a*) by an entraining action of the hydraulic fluid jetting out from the throat portion (18*a*) at high speed, wherein a plurality of the tapered portions (24*a*, 24*b*) are provided and the taper angles (θ1, θ2) of the plurality of the tapered portions are different from each other.

Due to the foregoing, when the taper angles (θ1, θ2) are reduced, in the case of tapered portions (24*a*, 24*b*), a change in the degree of opening of the throttle means (18) with respect to the displacement of the needle (24) can be reduced, that is, the degree of opening of the throttle means (18) can be more precisely controlled.

In the another case of tapered portions (24*a*, 24*b*), it is possible to shorten the entire length of the tapered portions (24*a*, 24*b*) by increasing the taper angles (θ1, θ2). Accordingly, even when a displacement of the needle valve (24) is small, the degree of opening of the throttle valve (18) can be more precisely fully opened and a flow rate of the refrigerant can be increased.

In the above ejector of the present invention, it is preferable that the taper angle (θ1) of one tapered portion (24*a*), which changes the degree of opening of the throttle means (18), among the plurality of the tapered portions (24*a*, 24*b*), is smaller than the taper angle (θ2) of the other tapered portion (24*b*).

Due to the foregoing, the taper angle (θ1) of one tapered portion (24*a*) to change the degree of opening of the throttle means (18) is smaller than the taper angle (θ2) of the other tapered portion (24*b*). Therefore, a change in the degree of opening of the throttle means (18) with respect to the displacement of the needle valve (24) in the axial direction (R) can be reduced. That is, the degree of opening of the throttle means (18) can be more precisely controlled.

In the respective ejectors described above of the present invention, it is preferable that the plurality of the tapered portions (24*a*, 24*b*) are formed so that the taper angles (θ1, θ2) can be increased as they come to the end portion on the throat portion (18*a*) side of the needle valve (24).

Due to the foregoing, as compared with the conventional example which is formed out of one taper angle, as the taper angles (θ1, θ2) of the tapered portions (24*a*, 24*b*) are increased as they come to the end portion on the throat portion (18*a*) side, the length of the tapered portions (24*a*, 24*b*) can be shortened. Accordingly, even when a displacement of the needle valve (24) is small, the degree of opening of the throttle means (18) can be more positively fully opened, and more refrigerant can be made to flow.

In this connection, reference numerals and signs in the parentheses in each means described above show the relations to the specific means described in the embodiment described later.

The present invention may be more fully understood from the description of preferred embodiments of the invention, as set forth below, together with the accompanying drawings.

DESCRIPTION OF THE PREFERRED EMBODIMENTS

First Embodiment

Figure 1:
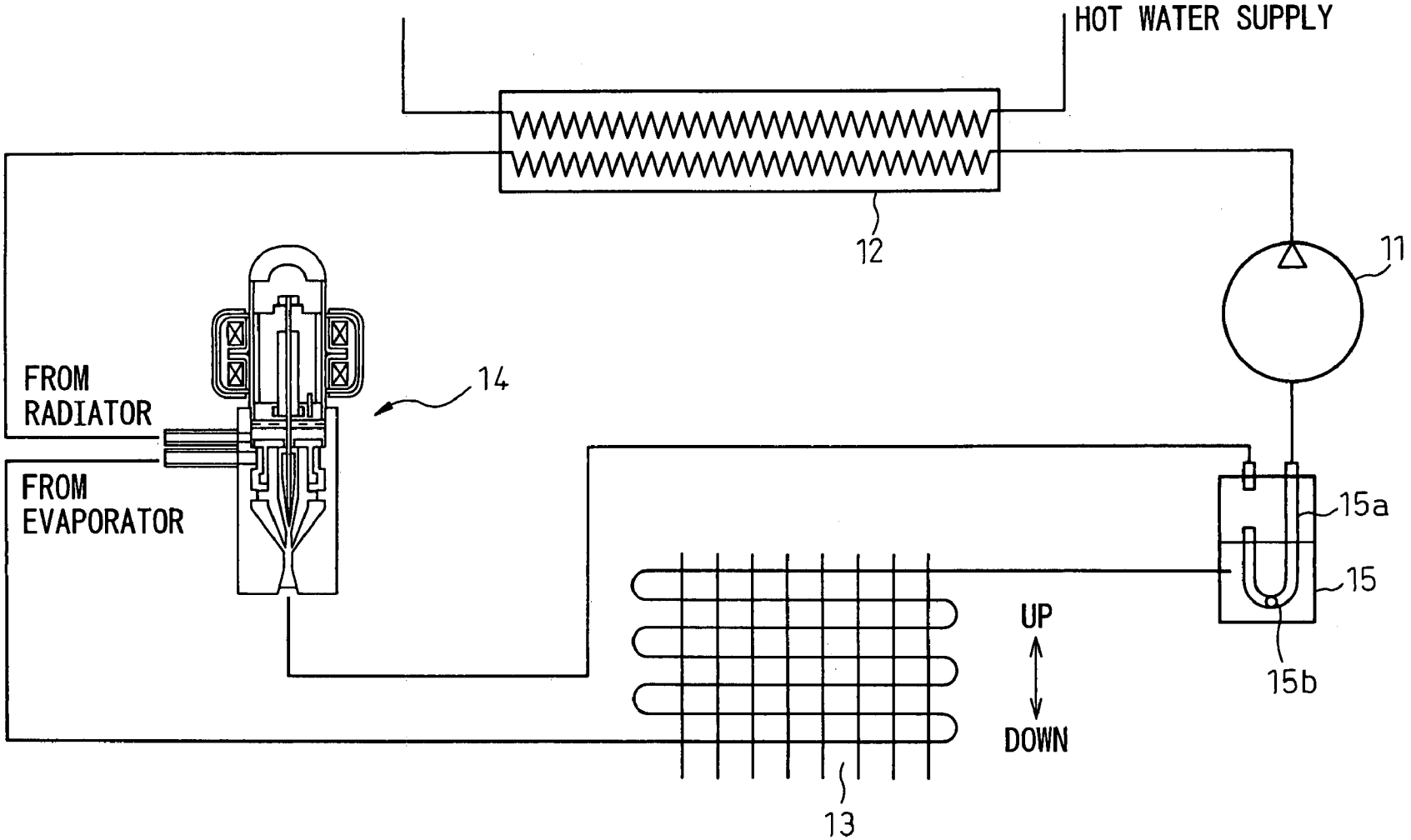
FIG. 1 is a schematic illustration showing a model of the first embodiment in which an ejector of the present invention is applied to an ejector cycle (hot water supply device)

In this embodiment, the ejector cycle of the present invention is applied to a heat-pump type hot water supply device in which carbon dioxide is used as refrigerant. FIG. 1 is a schematic illustration showing a model of the ejector cycle of the present embodiment.

Reference numeral 11 is a compressor driven by a drive source (not shown) such as an electric motor, for sucking and compressing refrigerant. Refrigerant at a high temperature and a high pressure discharged from this compressor 11 flows into the water refrigerant heat exchanger 12, which will be referred to as a radiator hereinafter, and heat is exchanged between the refrigerant and the hot water to be supplied. In other words, the refrigerant is cooled by the hot water. Reference numeral 13 is an evaporator 13 in which heat is exchanged between the liquid phase refrigerant and the outside air so that the liquid phase refrigerant can be evaporated and heat can be removed from the outside air to the refrigerant.

Reference numeral 14 is an ejector in which the refrigerant flowing out from the radiator 12 is decompressed and expanded so as to suck the gas phase refrigerant evaporated from the evaporator 13 and at the same time the expansion energy is converted into the pressure energy so that the suction pressure of the compressor 11 can be raised. In this connection, the detailed structure of the ejector 14 will be described later.

The serpentine-shaped evaporator 13 is shown in FIG. 1. However, this serpentine-shaped evaporator 13 is drawn as a model of the heat exchanger. Therefore, the evaporator 13 is not limited to this serpentine-shaped evaporator. What is called a multi-flow type heat exchanger, which is composed of a large number of tubes and several tanks, may be used.

Reference numeral 15 is a gas-liquid separator 15 in which the refrigerant flowing into the separator 15 is separated into the gas-phase refrigerant and liquid-phase refrigerant and stored. The thus separated gas-phase refrigerant is sucked into the compressor 11 and the thus separated liquid-phase refrigerant is sucked onto the evaporator 13 side.

In this connection, in order to decompress the refrigerant sucked into the evaporator 13 and positively reduce the pressure (evaporating pressure) in the evaporator 13, the refrigerant passage connecting the gas-liquid separator 15 with the evaporator 13 includes a capillary tube or a stationary throttle by which a predetermined pressure loss is generated when the refrigerant circulates.

In this connection, in order to ensure the lubricating property of the sliding portion of the compressor 11 and also in order to ensure the sealing property of the compressor 11, the refrigerant is mixed with a lubricant. In this embodiment, lubricant (PAG) is separated from the refrigerant in the gas-liquid separator 15 and accumulates on the lowermost layer of the gas-liquid separator 15. Therefore, the lubricant (the liquid-phase refrigerant containing much lubricant) is sucked from the oil returning hole 15*b*, which is provided in the lowermost portion of the U-shaped gas-phase refrigerant discharge pipe 15*a*, and supplied to the compressor 11 together with the gas-phase refrigerant.

Figure 2:
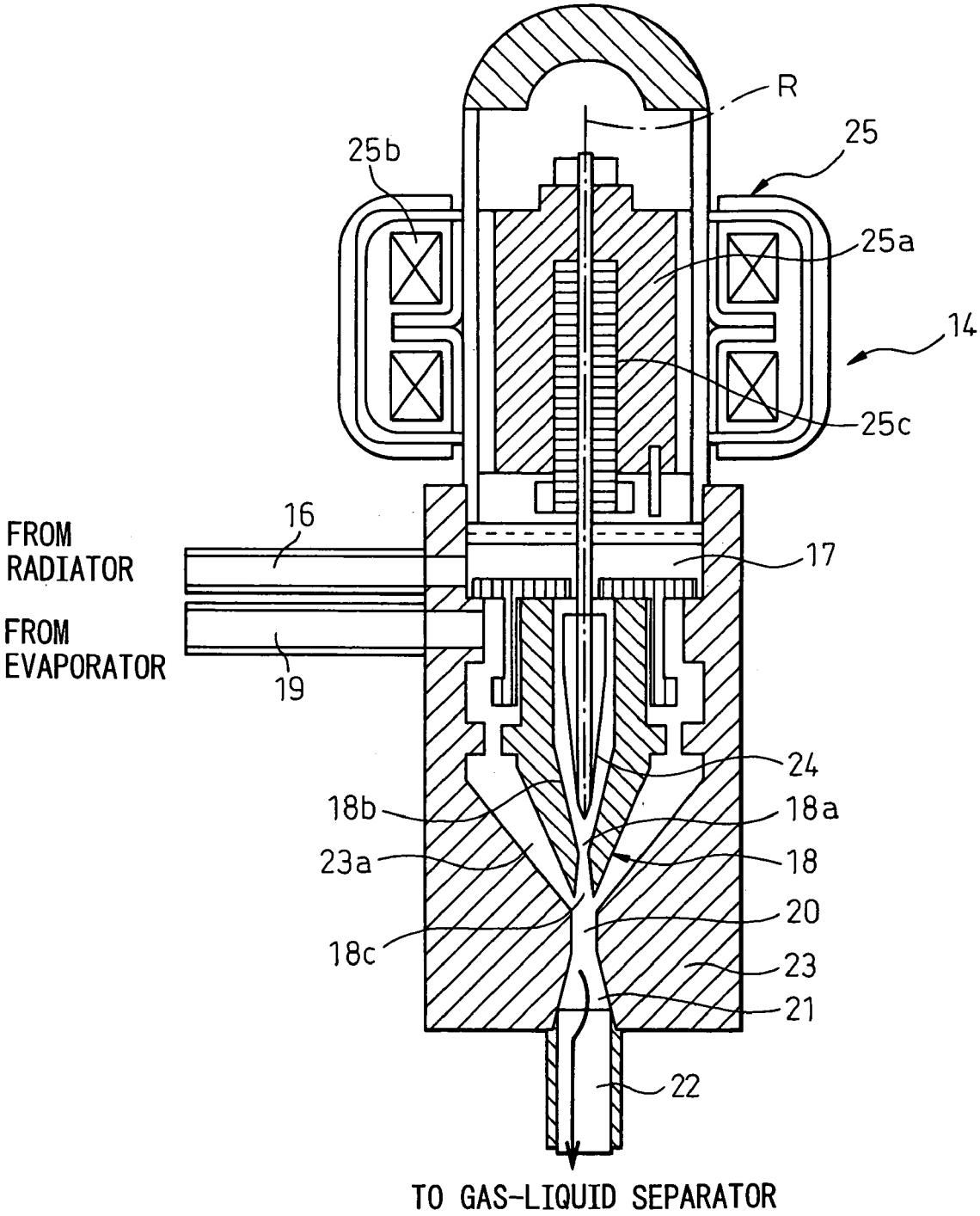
FIG. 2 is a sectional view showing an ejector of the first embodiment.

Next, referring to FIG. 2, the ejector 14 will be explained below. The ejector 14 is a well known variable flow rate type ejector of the prior art by which a flow rate of refrigerant can be changed. First, the refrigerant flowing out from the radiator 12 passes through the inlet port 16 and flows into the high pressure space 17 formed in the ejector 14 and further flows to the throat portion 18*a* of the nozzle 18. Between the high pressure space 17 and the throat portion 18*a* of the nozzle 18, the throttle portion 18*b* is arranged, in which a passage area of the refrigerant can be gradually reduced.

By this throttle portion 18*b*, the pressure energy (pressure head) of the high pressure refrigerant flowing out from the radiator 12 is converted into the velocity energy (velocity head) so as to decompress and expand the refrigerant. This embodiment employs a divergent nozzle, in the middle portion of the passage of which the throat portion 18*a* of the smallest passage area is provided.

The refrigerant, the velocity of which is increased in the nozzle 18, is injected from the injection port 18*c* into the suction space 23*a*. The suction space 23*a* is communicated with the gas phase flowing port 19 through which the refrigerant, which has become a gas phase refrigerant in the evaporator 13, flows into the ejector 14. Accordingly, by the entraining action of the refrigerant current (jet current) of high velocity injected from the nozzle 18, the refrigerant, which has become a gas phase refrigerant in the evaporator 13, is sucked into the ejector 14.

While the gas phase refrigerant, which is sucked from the gas phase flowing port 19, and the refrigerant current (jet current) of high velocity, which is injected from the nozzle 18, are being mixed with each other in the mixing portion 20, the thus mixed current flows into the diffuser 21. In the diffuser 21, the velocity energy of the mixed refrigerant is converted into the pressure energy so that the refrigerant pressure can be raised. The refrigerant, the pressure of which has been raised, flows into the gas-liquid separator 15 through the flowing-out port 22.

In this connection, the diffuser 21 and the mixing portion 20 are composed of the housing 23 in which the nozzle 18 is accommodated. The nozzle 18 is fixed to the housing 23 by means of press-fitting. In this connection, the nozzle 18 and the housing 23 are made of stainless steel.

Figure 3:
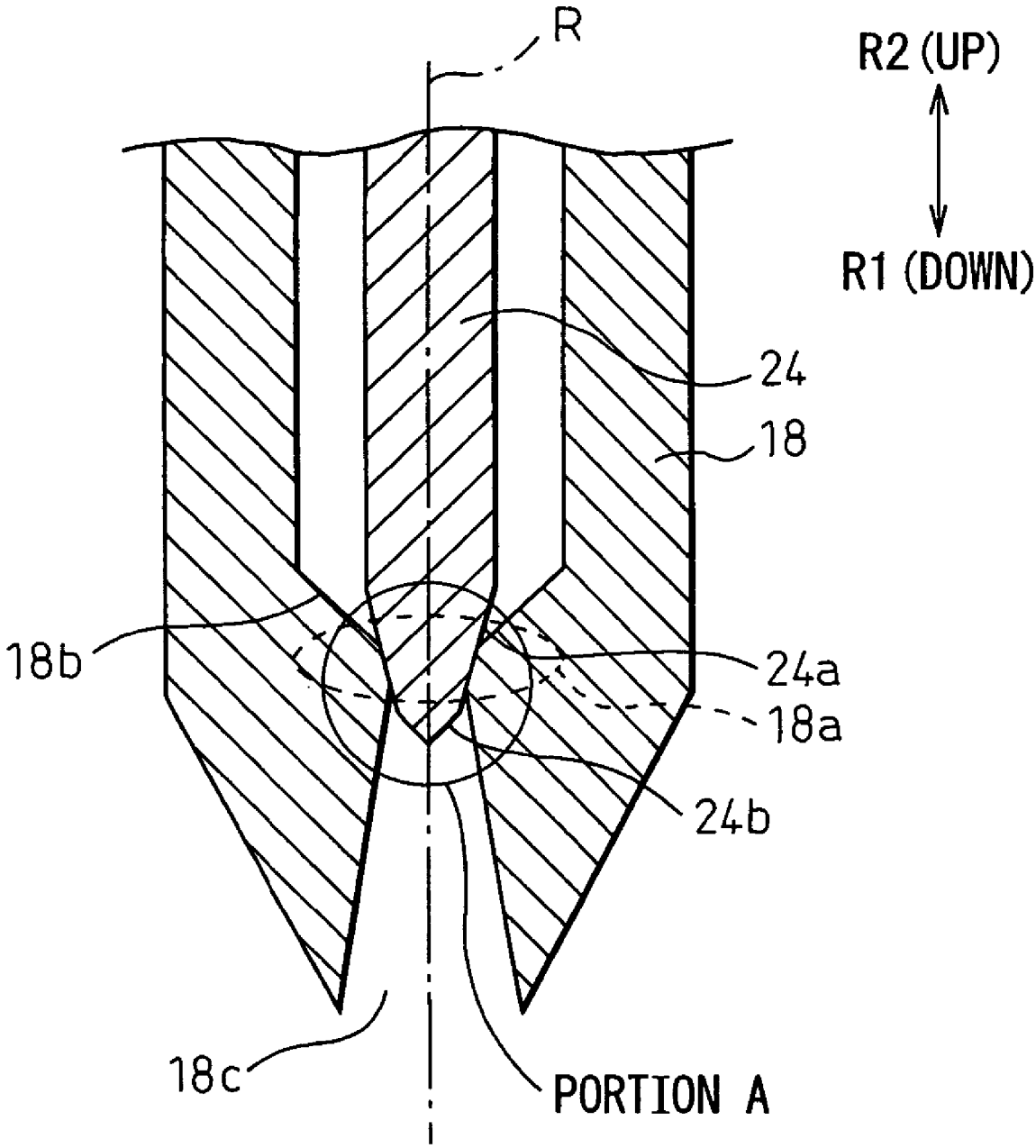
FIG. 3 is a sectional view showing a primary portion of the needle valve of the first embodiment.
Figure 4:
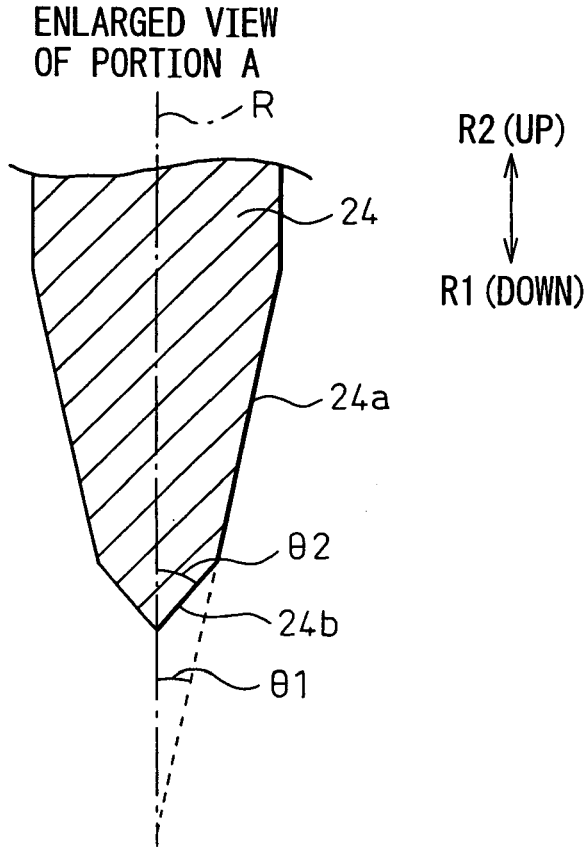
FIG. 4 is an enlarged view of portion A in FIG. 3.

In this connection, in the ejector 14 of this embodiment, when the needle valve 24 is displaced in the direction of the central axis R of the nozzle, a quantity of the refrigerant passing through the ejector 14 is controlled. Referring to FIGS. 2 to 4, this needle valve 24 will be explained as follows. The needle valve 24 is formed into a substantially needle shape. At the end portion in the axial direction of the needle valve 24 on the nozzle 18 side, the first tapered portion 24*a* and the second tapered portion 24*b* are formed which respectively have two different angles θ1 and θ2 so that the cross sectional area of the needle valve 24 can be reduced as it comes close to the nozzle 18.

In this case, the taper angle θ1, θ2 is defined as an angle by which axis R of the throttle portion 18*b* and the tapered face cross each other (shown in FIG. 4). In this embodiment, the taper angle θ1 of the first tapered portion 24*a* is smaller than the taper angle θ2 of the second tapered portion 24*b* on the throat portion 18*a* side of the needle valve 24. In this connection, the first taper angle θ1 is approximately 15° and the second taper angle θ2 is approximately 50°. Of course, the taper angle is not limited to the above specific value, that is, the taper angle can be variously changed. On the other hand, the end portion of the needle valve 24 on the opposite side to the nozzle is fixed to the electric type actuator 25.

In this embodiment, a stepping motor is employed for the actuator 25. The needle valve 24 is joined by means of screwing 25*c* to the magnet rotor 25*a* of the actuator (stepping motor) 25. Therefore, when the magnet rotor 25*a* is rotated, that is, when a predetermined step number is inputted into the stepping motor, the needle valve 24 is displaced in the axial direction by a distance proportional to the product of the rotary angle of the rotor 25*a* and the lead of the screw 25*c*. In this connection, reference numeral 25*b* is an exciting coil for generating a magnetic field.

In this connection, a drive current and a suction current are mixed with each other in the mixing portion 20 so that the sum of the momentum of the drive current and the momentum of the suction current can be conserved. Therefore, even in the mixing portion 20, the pressure (static pressure) of the refrigerant is raised. On the other hand, in the diffuser 21, as described before, when the sectional area of the passage is gradually extended, the velocity energy (dynamic pressure) of the refrigerant is converted into the pressure energy (static pressure). Accordingly, in the ejector 14, the refrigerant pressure is raised in both the mixing portion 20 and in the diffuser 21.

In the ideal ejector 14, it is preferable that the refrigerant pressure is increased so that the sum of the momentum of the drive refrigerant current and the momentum of the suction refrigerant current can be conserved in the mixing portion 20 and that the refrigerant pressure is increased so that the energy can be conserved in the diffuser 21. Accordingly, in this embodiment, the needle valve 24 is displaced by the actuator (stepping motor) 25, according to the heat load required by the heat exchanger 12, so that the degree of opening of the nozzle 18 can be variably controlled.

Next, the operation of the ejector of this embodiment composed as described above at the time of operation of variable capacity will be explained below. When the actuator (stepping motor) 25 displaces the needle valve 24 upward and downward as described above, on the cross section shown in FIG. 3, a distance between the first tapered portion 24*a* and the throat portion 18*a* of the nozzle 18 is changed. In this embodiment, when the needle valve 24 is displaced in the refrigerant injecting direction R1 (the downward direction in FIG. 3), a distance between the first tapered portion 24*a* and the throat portion 18*a* of the nozzle 18 is reduced, that is, the degree of opening of the nozzle 18 is reduced. When the needle valve 24 is displaced in the opposite direction R2 (the upward direction in FIG. 3) to the refrigerant injecting direction, the degree of opening of the nozzle 18 is extended.

Next, the operational effects of the first embodiment will be enumerated as follows.

(1) As a plurality of tapered portions 24*a*, 24*b* are formed in the needle valve 24 so that the taper angles θ1 and θ2 can be increased in order when they come to the end portion on the throat portion 18*a* side of the needle valve 24, the refrigerant passage area in the throat portion 18*a* at the time of full opening can be increased.

Figure 5:
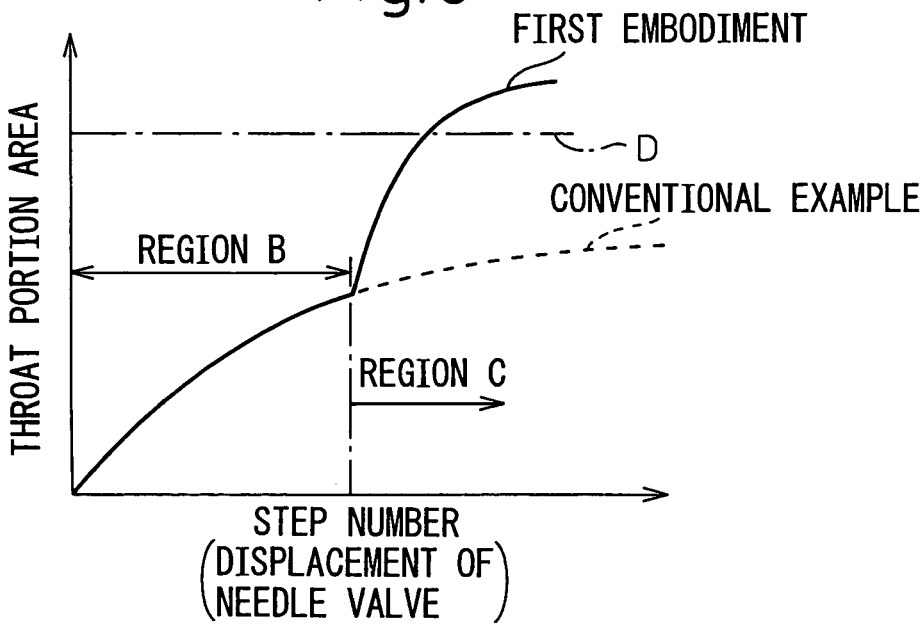
FIG. 5 is a graph showing a relation between the displacement of the needle valve and the opening area of the nozzle throat portion of the first embodiment.

FIG. 5 is a graph showing a relation between the displacement of the needle valve 24 and the refrigerant passage area, which will be referred to as a throat portion area hereinafter, of the throat portion 18*a*. When the needle valve 24 is displaced in the opposite direction R2 to the refrigerant injecting direction at the time when the needle valve 24 is completely closed (The step number and the displacement are zero.), a gap is generated between the first tapered portion 24*a* and the throat portion 18*a*, so that the throat portion area can be increased. In region B illustrated in FIG. 5, the throat portion area is adjusted by the first tapered portion 24*a*.

In this connection, in the case of the conventional example in which the tapered portion 50 is formed by one taper angle θ3, as shown by the dotted line in FIG. 5, the throat area is gradually increased. Therefore, it is impossible to sufficiently increase the throat portion area by the limited displacement of the needle valve 24 in which the displacement means 25 can displace the needle valve 24. Line D in FIG. 5 is the necessary minimum throat portion area which has been temporarily set. When the throat portion area is smaller than line D, even if the compressor 11 makes a necessary quantity of refrigerant flow, the pressure on the high pressure side of the ejector 14 (ejector cycle) tends to increase. Therefore, as a result, a flow rate of refrigerant must be decreased by reducing the rotating speed of the compressor 11, that is, it becomes impossible to make the necessary quantity of refrigerant flow in some cases.

However, in this embodiment, a portion (region C in FIG. 5) is provided in which the second tapered portion 24*b* adjusts the throat portion area when the needle valve 24 is displaced. As the taper angle θ2 of the second tapered portion 24*b* is large, when the needle valve 24 is displaced, the throat portion area can be suddenly increased. Further, since the taper angle θ2 of the second tapered portion 24*b* is large, the length of the tapered portion is short, and it becomes possible to extend the throat portion area by a small displacement of the needle valve 24. Accordingly, by a limited displacement of the needle valve 24 which can be accomplished by the displacement means, the throat portion area can be more extended and more refrigerant can be made to flow. Due to the foregoing, unlike the conventional example, it is unnecessary to decrease the rotating speed of the compressor, and the system control can be simplified.

(2) The taper angle θ1 of the first tapered portion 24*a* to adjust a flow rate of refrigerant can be reduced smaller than the other taper angle θ2. Therefore, the flow rate of refrigerant can be more precisely adjusted.

According to the above structure, the taper angle θ1 of the first tapered portion 24*a* to change the opening (throat portion area) of the nozzle 18 is smaller than the taper angle θ2 of the other tapered portion 24*b*. Therefore, a change in the throat portion area of the nozzle 18 with respect to the displacement of the needle valve 24 in the axial direction R can be reduced. That is, the degree of opening of the throttle means 18 can be more precisely controlled.

Due to the operational effects described in items (1) and (2), the throat portion area can be precisely controlled by the first tapered portion 24*a*, and the throat portion area can be extended by the second tapered portion 24*b* when the needle is displaced by a limited displacement.

Second Embodiment

Figure 6:
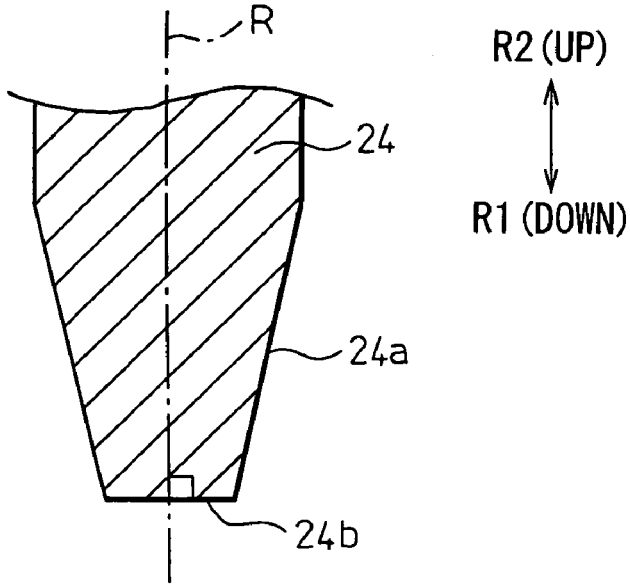
FIG. 6 is a sectional view showing a tapered portion of the needle valve of the second embodiment.
Figure 7:
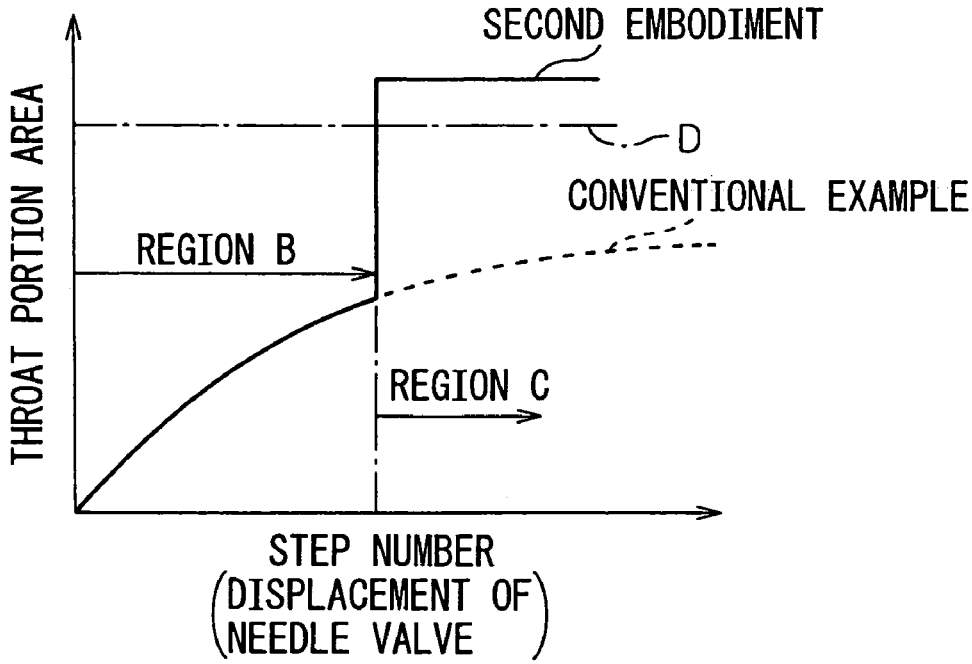
FIG. 7 is a graph showing a relation between the displacement of the needle valve and the opening area of the nozzle throat portion of the second embodiment.
Figure 8:
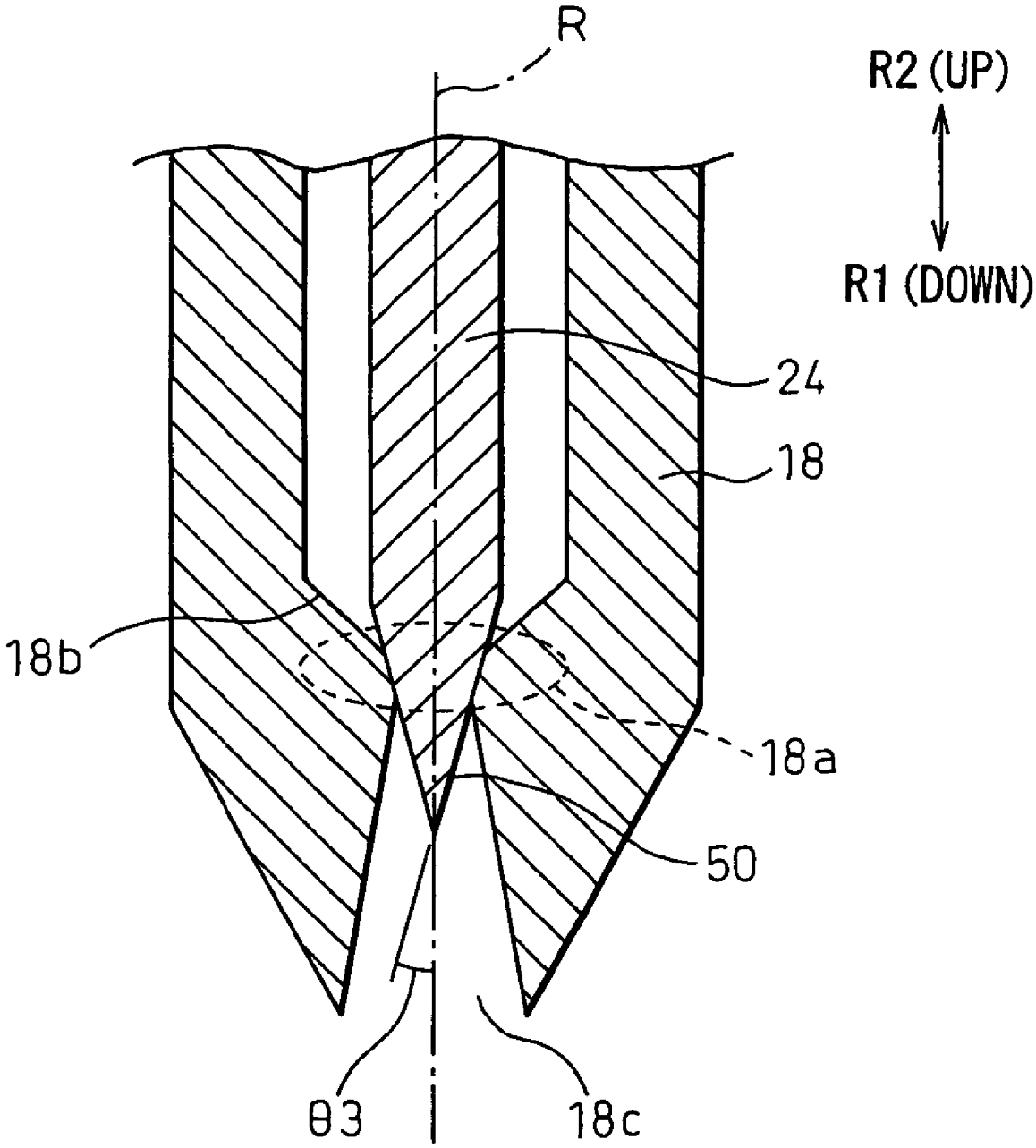
FIG. 8 is a sectional view showing a primary portion of the needle valve of the prior art.

The constitution of the second embodiment is substantially the same as that of the first embodiment. However, as shown in FIG. 6, the taper angle θ2 of the second tapered portion 24*b* is perpendicular to the nozzle axis R in the second embodiment. Due to the above constitution, the operational effect (2) of the first embodiment can be more remarkably exhibited. As shown in FIG. 7, when the needle valve 24 is displaced beyond region B in which the first tapered portion 24*a* adjusts the throat portion area, the throat portion area can be fully opened at a stroke (region C in FIG. 7). Due to the foregoing, the throat portion area can be extended by a limited needle displacement.

In this connection, in the second embodiment, of course, the operational effect (1) described in the first embodiment can be exhibited.

Another Embodiment

In the above embodiment, the present invention is applied to an example in which the ejector cycle is used for a hot water supply device. However, it should be noted that the present invention is not limited to the above specific example. Of course, the present invention can be applied to a refrigerating cycle, in which the ejector is used, such as a refrigerating cycle of a refrigerating machine or an air conditioner for vehicle use.

In the embodiment described above, the needle valve is displaced upward and downward. Of course, the same effect can be provided by the present invention even in the case of an ejector in which the needle valve is displaced to the right and left.

While the invention has been described by reference to specific embodiments chosen for purposes of illustration, it should be apparent that numerous modifications could be made thereto by those skilled in the art without departing from the basic concept and scope of the invention.

The invention claimed is:

1. An ejector comprising:

a high pressure space into which high pressure fluid flows from an inlet;

a throttle means having a throttle portion by which a passage area of the high pressure fluid is reduced from the high pressure space toward a throat portion;

a needle valve for changing a degree of opening of the throttle means when the needle valve is displaced in the axial direction (R) of the throttle portion;

a tapered portion formed at an end portion on the throat portion side of the needle valve; and a suction space having a second inlet into which fluid flows, the throttle means being arranged in the suction space, the fluid being sucked from the second inlet into the suction space by an entraining action of the hydraulic fluid jetting out from the throat portion at high speed, wherein a plurality of the tapered portions are provided and the taper angles (θ1, θ2) of the plurality of the tapered portions are different from each other.

2. An ejector according to claim 1, wherein the taper angle (θ1) of one tapered portion, which changes the degree of opening of the throttle portion, among the plurality of the tapered portions, is smaller than the taper angle (θ2) of the other tapered portion.

3. An ejector according to claim 1, wherein the plurality of the tapered portions are formed so that the taper angles (θ1, θ2) increase near the end portion on the throat portion side of the needle valve.

* * * * *